US006380856B1

(12) United States Patent
Johnson et al.

(10) Patent No.: US 6,380,856 B1
(45) **Date of Patent: *Apr. 30, 2002**

(54) BAGGAGE ENTERTAINMENT DEVICES AND METHODS

(76) Inventors: Ingrid H. Johnson; Joey Johnson; Linda H. Johnson, all of 21367 Chirping Sparrow Rd., Diamond Bar, CA (US) 91765

( * ) Notice: Subject to any disclaimer, the term of this patent is extended or adjusted under 35 U.S.C. 154(b) by 0 days.

This patent is subject to a terminal disclaimer.

(21) Appl. No.: 09/656,534

(22) Filed: Sep. 7, 2000

Related U.S. Application Data

(63) Continuation-in-part of application No. 09/224,979, filed on Jan. 4, 1999, now Pat. No. 6,121,877, which is a continuation-in-part of application No. 08/950,405, filed on Oct. 15, 1997, now abandoned.

(60) Provisional application No. 60/055,858, filed on Aug. 15, 1997.

(51) Int. Cl.[7] ..... G08B 13/14

(52) U.S. Cl. ..... 340/571; 340/568.7

(58) Field of Search ..... 340/571, 568.7, 340/568.6, 568.1, 692

(56) References Cited

U.S. PATENT DOCUMENTS 4,804,943 A * 2/1989 Soleimani ..... 340/539
5,043,702 A * 8/1991 Kuo ..... 340/539
5,123,467 A * 6/1992 Steinberg ..... 150/106
5,148,150 A * 9/1992 White et al. ..... 340/571
5,500,636 A * 3/1996 Mitchell ..... 340/328
5,544,745 A * 8/1996 Famorca ..... 206/320
5,661,456 A * 8/1997 Staehle, Jr. ..... 340/571
5,721,532 A * 2/1998 Lehmann et al. ..... 340/571

* cited by examiner

*Primary Examiner*—Jeffery Hofsass
*Assistant Examiner*—Sihong Huang
(74) *Attorney, Agent, or Firm*—Robert D. Fish; Fish & Associates, LLP

(57) ABSTRACT

A piece of baggage comprises a relatively small electronic sound recorder and playback device, and a designated location for the device that constrains the device in a relatively fixed position. The baggage is preferably a general purpose piece, and more preferably has at least one or two shoulder straps. Exemplary pieces of baggage are knapsacks and pocketbooks, although computer carrying cases and some strap containing briefcases may also fit within these limitations. The electronic sound recorder and playback device may contain any suitable electronic circuitry, and may advantageously be configured to provide or at least assist in providing an alarm. The device may also be configured to record speech, music, or other sounds. The recorder/playback device should have sufficient capacity to record at least 120 seconds of speech, although both greater or lesser capacities are also contemplated. The recorder/playback device may have any suitable actuation/control mechanism, including a movement actuated switch, or a distally actuated switch. The device may be constrained to the designated location by mechanical mechanism (e.g., a sewn seam, a pouch, Velcro™, etc), a magnet, or chemical (e.g., glue, adhesive, etc).

4 Claims, 1 Drawing Sheet

BAGGAGE ENTERTAINMENT DEVICES AND METHODS

This application is a continuation-in-part of U.S. Pat. No. 09/224,979, filed Jan. 4, 1999 now U.S. Pat. No. 6,121,877, issued on Sep. 19, 2000), which is a continuation-in-part of U.S. Pat. No. 08/950,405, (filed Oct. 15, 1997, now abandoned), which claims priority to provisional application serial no. 60/055,858 (filed Aug. 15, 1997, expired).

FIELD OF THE INVENTION

The field of the invention is personal baggage.

BACKGROUND OF THE INVENTION

Personal baggage is generally used to carry clothing, papers, toys and portable items such as personal hygiene devices, toys, tools and so forth. Many different types of personal baggage are known, including formal or casual apparel such as handbags and brief cases, travel containers such as suitcases and garment bags, and sporting or educationally directed items such as knapsacks and school bags.

A common element of all baggage is that it provides an available enclosed carrying volume. Where the baggage is designed to carry a single item, the item may fill at least 50%, 60%, 70%, 80%, or even 90% of the available enclosed carrying volume. In such special purpose baggage the carried item is also substantially constrained within the carrying space, so that it cannot move about very much. Examples include a carrying case designed for a Palm Pilot™, or a padded case for a laptop computer. In other instances the baggage may be intended more for general purpose use. Thus, a knapsack or pocketbook are each used to carry any number of items, with many of the items may fill less than 50% of the available enclosed carrying volume, and not particularly constrained as to their locations within the carrying space.

Of particular interest are general purpose baggage items that have at least one shoulder strap. Knapsacks fall into this category, as well as some ladies' pocketbooks, many generic portable computer carrying bags, and so forth. As used herein, the term "knapsack" refers generically to all manners of general purpose backpacks, back sacks, rucksacks, hiking bags, day packs and the like. Of even greater interest are general purpose baggage items that have two shoulder straps, i.e., those designed to be carried on the shoulders like a knapsack.

It is known to include an alarm on or inside a piece of baggage in least three different ways. In a first category, it is known to protect personal baggage using an unauthorized entry alarm. Known alarms in this category are generally, or perhaps exclusively, at least partially external to the baggage, and this feature may be intended to provide a visual deterrent against theft. U.S. Pat. No. 5,510,768 to Mann, for example, describes a typical unauthorized entry alarm which relies upon disengagement of an external strap to trigger an audible alarm. In a second category it is known to protect personal baggage with a motion or proximity alarm. U.S. Pat. No. 3,701,140 to Dixon, for example, discloses an alarm which sounds when baggage is pulled from the owner's grasp, and U.S. Pat. No. 5,164,706 to Chen discloses a proximity alarm that sounds when someone or something gets too close to the baggage. Similarly, U.S. Pat. No. 5,434,559 describes an audible or visible alarm which is activated when movement of a protected article is sensed. In a third category, a remote control alarm circuitry is used to protect personal baggage. In U.S. Pat. No. 5,043,702 to Kuo, for example, hand bags, briefcases and other items are provided with a remotely activated alarm which provides both an audible signal, and also a high voltage shock.

Significantly, all of the aforementioned baggage alarms are intended solely to discourage or prevent theft. In fact, the purpose of such alarms is to annoy, alert, and to discourage retention of the baggage while the alarm is sounding. The present inventor, however, has recognized that the annoying nature of baggage alarms make them unappealing for use in conjunction with sporting or educationally directed baggage such as knapsacks and lunch boxes, especially where such baggage is marketed towards children. Nevertheless, children are prone to losing both their personal items and their knapsacks or other baggage containing such personalty, (from theft or otherwise), and there is a need to combine sporting or educational directed baggage with some sort of alarm, as well as some sort of entertaining or at least pleasing sound playback device.

It is also known to include an electronic sound recorder and playback device inside a piece of baggage. For example, with respect to special purpose carrying cases, it is known to include a handheld dictation machine such as a Dictaphone™ inside a Dictaphone™ carrying case. Similarly, a laptop computer and microphone can be used as an electronic sound recorder and playback device, and can be stored or carried in a computer bag or case. But in each of those instances the recording/playback device a relatively large portion (defined herein to be at least 30%) of the total available carrying volume of the case.

With respect to general purpose baggage, such as a pocketbook or knapsack, it is known to carry an electronic sound recorder and playback device inside the baggage. In those circumstances the recording/playback device may take up only a relatively small portion of the available carrying volume, but then the device is not constrained to a designated recorder/playback device location within the baggage.

There are instances where it would be desirable to include an electronic sound recorder and playback device more or less constrained to a designated location inside a general purpose baggage item, but relatively small in comparison to the total carrying volume. For example, it would be useful for a student to have a dictation machine inside his or her knapsack, but situated in a small pouch rather than moving about freely within the main carrying space, or perhaps attached with Velcro walls of the knapsack or to the flap.

SUMMARY OF THE INVENTION

The present invention is directed to baggage comprising a relatively small electronic sound recorder and playback device, and a designated location for the device that constrains the device in a relatively fixed position.

The baggage is preferably a general purpose piece, and more preferably has at least one or two shoulder straps. Exemplary pieces of baggage are knapsacks and pocketbooks, although computer carrying cases and some strap containing briefcases may also fit within these limitations.

The electronic sound recorder and playback device may contain any suitable electronic circuitry, and may advantageously be configured to provide or at least assist in providing an alarm. The device may also be configured to record speech, music, or other sounds. The recorder/playback device should have sufficient capacity to record at least 120 seconds of speech, although both greater or lesser capacities are also contemplated.

The recorder/playback device may have any suitable actuation/control mechanism, including a movement actuated switch, or a distally actuated switch. The device may be constrained to the designated location by mechanical mechanism (e.g., a sewn seam, a pouch, Velcro™, etc), a magnet, or chemical (e.g., glue, adhesive, etc).

Various objects, features, aspects and advantages of the present invention will become more apparent from the following detailed description of preferred embodiments of the invention, along with the accompanying drawings in which like numerals represent like components.

DETAILED DESCRIPTION OF THE DRAWING

Figure 1:
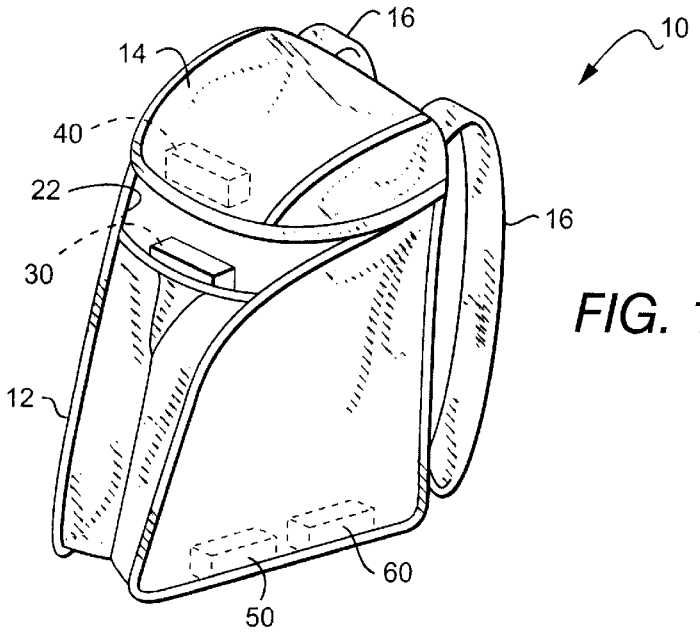
FIG. 1 is a schematic of a knapsack according to the inventive subject matter.

In FIG. 1, a knapsack 10 comprises a body 12, a flap 14, shoulder straps 16, a sensor 50, a recorder/playback device 60, and connecting wires (not shown).

There is no particular significance to the design of the knapsack as shown in FIG. 1, and indeed the term knapsack is used herein in its broadest generic sense. Still further, a knapsack is merely one example of a piece of general purpose baggage having a shoulder straps and a flap-type closure. Such baggage generally includes backpacks, back sacks, knapsacks, hiking bags, day packs, school bags, belt packs and duffel bags, and many lunch boxes, briefcases, computer cases, camera cases, handbags, suitcases and so forth.

The knapsack 10 defines a main carrying space 11, which is sufficiently large that the recording/playback device 60 is less than 30% of the available carrying volume. There is no particular magic to this number, and it is also contemplated that the relative sizes of the baggage and recording/playback device would provide a corresponding ratio of less than 20%, 10%, 5%, and at the other end would provide a corresponding ratio of greater than 40%, 50%, or 60%.

The designated location for the recording/playback device 60 can be anywhere on or in the baggage. Thus, the designated location may be on or in the flap 14, on or in the main body carrying space 11, or even in some external or internal pocket. The location may be "designated" in any suitable manner, including through advertisement, or through some physical adaptation. Particularly contemplated adaptations include small pouches, with or without a flap or other closure, Velcro™, magnets, glue, and so forth. The adaptation preferably provides for relatively easy removal of the device by a user. Constraining the recording/playback device in a relatively fixed position means that the device is not permitted to spatially translate by more than three inches in any direction. More preferable constraints are stricter, providing movement by less than two inches, one half inch, or one third of an inch in any direction.

With current technology the recording/playback device 60 is most likely limited to less than about 20 minutes of voice or music recording. Greater or lesser capacities are also contemplated, however, including recording of more than 30, 40, 50, or 60 minutes, and also less than 15, 10, 5, or two minutes.

Sensor 50 is intended to sense opening and/or closing of the flap 14. To this end the sensor 50 cooperates with magnetic switch elements 30, 40 positioned on opposite sides of rim 22 to detect opening and closing of the knapsack. When the knapsack is closed, the proximity of the magnets to each other may advantageously produce a signal in the detector circuit, and when the opening is opened, the lack of proximity of the magnets to each other may advantageously produce a different signal in the detector. The magnets in such an embodiment can be sewn into the knapsack, or alternatively they can be removably held within a pocket near the opening, or removably attached using Velcro™ or other adhering means. An electronic circuit for operating the sensor can be similar to that found in the above referenced patents, or can be of another design.

Of course alternative sensors need not be coupled to magnetic switches, and need not necessarily even sense opening and closing. Alternative sensors are contemplated to include motion detectors, proximity detectors and electromagnetic energy detectors that may respond to remote control devices. Thus, events contemplated to be detected by a sensor in the present subject matter include all detectable events, including access (i.e., opening of the baggage), motion, receipt of a remote control signal, temporal events such as the end of a pre-set time span, or occurrence one or more preset times, a temperature change, or a pressure change. The sensor may also be actuated by a distal source such as a sound or radio wave transmitter of some sort.

Sensors according to the inventive subject matter can thus comprise anything capable of detecting events, can have any reasonable shape and size, and can be located anywhere in relation to the baggage. Thus, the sensor may be fully, or at least partially hidden from external view. In other aspects, the sensor may be either fixed or removable from the baggage, such that a single sensor can be utilized in different backpacks or other pieces of baggage. In other aspects, the sensor can have an on-off switch and/or a volume control which may be static or which may increase or decrease in volume over time. In yet another aspect the sensor may receive a combination or PIN (personal identification) code that can be used in conjunction with turning on, turning off or opening the baggage.

When the sensor detects an event as discussed above, it triggers an action of the recorder/playback device 60. Contemplated actions include start or stop recording, start or stop playing, "rewind", "fast forward", power up, power down, and so forth. Some of the played sounds may be prerecorded, such as an entertaining signal, segment of music, chimes or bells, a voice, animal sounds, or a beeping sound or pattern such as that heard on a pager or telephone. The playback may optionally or alternatively comprise another sense modality, such as a blinking light, a smell or a vibration.

As the term is used here, an "entertaining signal" means a signal which is sensible to a typical human, but which is unlikely to produce an alarm reaction in such person. Thus, classical music, pop music, or even rap music played at reasonable sound levels, (for example, less than 80 dB) falls within the term "entertaining signal," even though the music may be discordant, disharmonious, cacophonous or otherwise unpleasant to some listeners. Similarly, rhythmic or arrhythmic beeping sounds or blinking lights would generally also fall within the term "entertaining signal." Still further, an "entertaining signal" as the term is used herein includes the "entertainment sound" as defined in U.S. Pat. No. 5,245,666 and U.S. Pat. No. 4,389,639, and the "entertaining music" as used in U.S. Pat. No. 4,864,410. By way of further clarification, however, a loud honking, siren or other sound calculated to instill immediate apprehension or other alarm reaction in a typical person would not fall within the term "entertaining signal."

The circuitry for the recording/playback device can take any suitable form. Such circuitry is well within the ordinary skill in the art, and includes that found in modem digital or analog dictation machines. In preferred embodiments, the playback portion of the circuit is user programmable, so that the user can determine alarm or other playback criteria, and the response or responses that are to be employed in connection with particular circumstances. Thus, movement of the baggage containing the sensor may be programmed to produce a pattern of chimes, while opening of the baggage may produce prerecorded music or sounds from a radio, and the end of a school class period may produce blinking lights. It is also contemplated that the apparatus may be programmed to provide a delay of at least a ½ second between detection of the event and production of the entertaining signal. Similarly, a slow opening motion of the baggage may cause the start of recording, while a fast opening motion may trigger an alarm, or playback.

In addition to a delay, recorder/playback device 60 may advantageously be provided with on-off and volume control functionalities. Suitable switches are well-known. A panic button, not shown, may also be included that triggers an alarm.

In general, both sensor and recording/playback circuitry would utilize a local power source. Where a local power source is used, it can include batteries, capacitors or any number of other portable power sources. The local power source is also preferably user replaceable, and may also be rechargeable. In the case of a rechargeable local power source, the circuitry may be coupled to a power cord for use in recharging.

Figure 2:
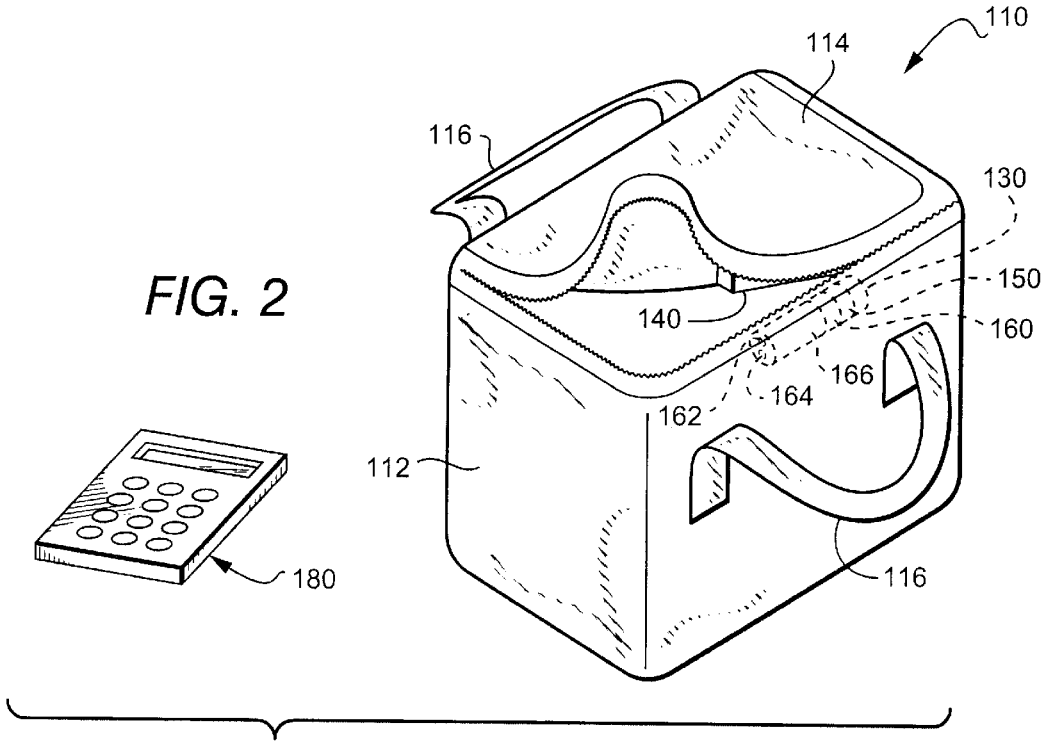
FIG. 2 is a schematic of an alternative embodiment of a piece of baggage according to the inventive subject matter.

In FIG. 2, a food cooler 110 comprises a body 112, a zippered flap 114, and two carrying straps 116. An entertainment device is sewn into, or otherwise coupled to the cooler 110, and includes magnetic elements 140 and 130, a sensor 150, and a recorder/playback device 160 having an on-off switch 162, a volume control 164, and a remote control receiver 166.

Although the disclosure relating to magnetic elements 40, 30, sensor 50, and recorder/playback device 60 generally apply to magnetic elements 140, 130, sensor 150 and recorder/playback device 160, there are several differences. For example, the sensor 150 and the recorder/playback device 160 are coupled together in the same physical unit, rather than being embodied separately. In addition, the same unit that houses the sensor 150 and recorder/playback device 160 also includes a remote control receiver 166 that cooperates with a remote control transmitter 180. Where remote control is embodied, it is contemplated that any or all of the various functionalities can be remotely controlled, including delay, on-off, and volume control.

Thus, specific embodiments and applications of methods and apparatus for entertaining have been disclosed. It should be apparent, however, to those skilled in the art that many more modifications besides those already described are possible without departing from the inventive concepts herein. For example, both the knapsack and the sensor mechanism can have any other reasonable size, shape, and configuration, relative position and connection. The inventive subject matter, therefore, is not to be restricted except in the spirit of the appended claims.

What is claimed is:

1. A piece of baggage comprising:

an electronic sound recorder and playback device sized to less than 30% of an available carrying volume of the baggage that reproduces a sound stored by a user and that is actuated upon occurrence of an event other than a movement of the baggage; and a designated location for the device that constrains the device in a relatively fixed position with respect to the baggage, wherein the piece of baggage comprises a flap operatively coupled with an operation of the electronic sound recorder and playback device.

2. The piece of baggage of claim 1 wherein the electronic sound recorder and playback device contains an electronic circuitry configured to assist in providing an alarm.

3. The piece of baggage of claim 1 further comprising a movement actuated switch that causes the electronic sound recorder and playback device to begin recording when the baggage is opened.

4. The piece of baggage of claim 1 wherein the electronic sound recorder and playback device is at least partially constrained to the designated location by at least one of a mechanical, magnetic, and chemical constraint.

* * * * *